United States Patent [19]

van den Brom

[11] 4,228,043

[45] Oct. 14, 1980

[54] LIQUID DETERGENT COMPOSITION

[75] Inventor: Guido C. van den Brom, Nieuw-Beijerland, Netherlands

[73] Assignee: Lever Brothers Company, New York, N.Y.

[21] Appl. No.: 934,739

[22] Filed: Aug. 21, 1978

[30] Foreign Application Priority Data

Aug. 22, 1977 [GB] United Kingdom ..... 35089/77

[51] Int. Cl.[2] ..... C11D 3/06; C11D 3/30; C11D 11/04; C11D 17/08

[52] U.S. Cl. ..... 252/529; 252/110; 252/135; 252/526; 252/532; 252/539; 252/540; 252/173; 252/363.5; 252/DIG. 14

[58] Field of Search ..... 252/110, 111, 117, 118, 252/173, 363.5, 529, 548, DIG. 14

[56] References Cited

U.S. PATENT DOCUMENTS

| | | | |
|---|---|---|---|
| 2,335,466 | 11/1943 | Volz | 252/109 |
| 3,021,284 | 2/1962 | Doan | 252/110 |
| 4,018,720 | 4/1977 | Lengyel | 252/534 |

FOREIGN PATENT DOCUMENTS

| | | | |
|---|---|---|---|
| 1093935 | 12/1967 | United Kingdom | 252/539 |

*Primary Examiner*—Dennis L. Albrecht
*Attorney, Agent, or Firm*—James J. Farrell; Melvin H. Kurtz

[57] ABSTRACT

In a process for making an aqueous built liquid detergent composition comprising sodium tripolyphosphate and alkalimetal orthophosphate, the formation of alkalimetal orthophosphate in situ by neutralization may cause some sediment. This sediment formation is significantly reduced by the addition of a small amount of an alkanolamine such as triethanolamine to the liquid detergent composition.

2 Claims, No Drawings

LIQUID DETERGENT COMPOSITION

The present invention relates to aqueous built liquid detergent compositions, and more particularly to such compositions comprising a mixture of sodium tripolyphosphate and an alkalimetal orthophosphate as the builder component.

Such formulations are the object of applications Ser. Nos. 799,861 and 798,556 which are herein incorporated by reference. In these applications we have described and claimed compositions, which contain 2–20% by weight of an active detergent, at least 2% by weight of sodium tripolyphosphate, at least 2% by weight of an alkalimetal orthophosphate, the sum of the two phosphate builders being 5–35% by weight, and a hydrotrope or a stabilizing system.

According to these earlier applications, it is possible to prepare the orthophosphate builder salt in situ, by neutralizing orthophosphoric acid, added to the formulation, by a suitable base such as potassium hydroxide.

However, such a procedure might cause some sediment in the liquid composition, which detracts from the otherwise satisfactory properties of these products.

It has now been found that this problem can be overcome by adding a small amount of an alkanolamine to such systems.

The present invention therefore relates to an aqueous built liquid detergent composition of the type as described above, in which the alkalimetal orthophosphate is produced in situ by neutralization of orthophosphoric acid, wherein the improvement consists in adding a small amount of an alkanolamine to said liquid detergent composition.

An additional benefit of the present invention is that it also enables to prepare compositions with a higher level of sodium tripolyphosphate, i.e. above about 12% by weight of the composition, without having to use a particular type of sodium tripolyphophate, i.e. a rapidly hydrating one or one which has a high phase I content, as is advocated in the above-mentioned applications.

The alkanolamine to be used in the present invention is a mono-, di-or trialkanolamine, wherein the alkanol is ethanol, propanol or isopropanol. Particularly preferred is triethanolamine. In general the alkanolamine is used in an amount of from 0.5 to 5% by weight of the composition.

The amount of orthophosphoric acid, neutralized in situ by an appropriate neutralizing agent, such as KOH, is such that it provides an amount of the alkalimetal orthophosphate within the ranges as specified in the above-mentioned applications.

The other ingredients of the composition of the invention are as described and claimed in the above-mentioned applications, which are herein incorporated by reference.

EXAMPLE I

The following liquid detergent composition was prepared.

| | % by weight |
|---|---|
| $C_{11-12}$ alkylbenzene sulphonic acid (98%) | 6 |
| $C_{13-15}$ linear alcohol, condensed with 8–9 moles of ethylene oxide + propylene oxide (molar ratio of EO:PO = 92:8) | 2.5 |
| oleic acid | 5.0 |
| sodium tripolyphosphate (containing 15% Phase I and 1.5% water) | 16.5 |
| orthophosphoric acid (85%) | 3.2 |
| KOH (50%)* | 14.4 |
| sodium toluenesulphonate | 6.0 |
| perfume, fluorescer, dye | 0.28 |
| triethanolamine | 1.0 |
| water | balance |

*to neutralize the sulphonic acid, oleic acid and the orthophosphoric acid.

This liquid was a clear, stable liquid, pourable at 0° C. It had a pH of 12.5, and a viscosity of 200 cP (Brookfield viscosimeter, spindle nr. 3 at 30 rpm, temperature 22° C.).

EXAMPLE II

The following liquid detergent compositions were prepared.

| | % by weight | |
|---|---|---|
| | A | B |
| $C_{11-12}$ alkylbenzene sulphonic acid (98%) | 8.0 | 10.0 |
| $C_{13-15}$ linear alcohol, condensed with 8–9 moles of ethylene oxide + propylene oxide (molar ratio of EO:PO = 92:8) | 2.0 | 2.5 |
| coconut fatty acid | 1.0 | — |
| oleic acid | — | 5.0 |
| sodium tripolyphosphate (15% Phase I, 1.5% water) | 16.5 | 16.0 |
| orthophosphoric acid (85%) | 2.7 | 3.2 |
| KOH (50%) | 12.2 | 16.0 |
| sodium toluene sulphonate | 6.0 | 6.0 |
| coconut fatty acid diethanol amide | 2.0 | — |
| triethanol amine | 1.0 | 1.0 |
| potassium carbonate | 2.0 | — |
| perfume, fluorescer, dye | 0.3 | 0.28 |
| water | balance | balance |

Product A had a viscosity of 200 cP (Brookfield, spindle 3, 30 rpm, temperature 22° C.) and a pH of 12.5, and was clear and stable on storage down to −5° C.

Product B was clear and stable for several months at room temperature. At 0° C. some thickening occurred, but no solidification. In washing machine experiments, even with clean fabrics, no overfoaming occurred.

EXAMPLE III

The following clear, high-sudsing liquid detergent was prepared.

| | % by weight |
|---|---|
| potassium $C_{11-12}$ alkylbenzene sulphonate (neutralized with KOH in situ) | 10 |
| sodium salt of sulphated Chd 12–$C_{15}$ alcohol, condensed with 3 moles of ethylene oxide | 5 |
| coconut fatty acid diethanol amide | 2 |
| potassium coconut soap (neutralized in situ with KOH) | 1 |
| triethanol amine | 1 |
| sodium xylene sulphonate | 7 |
| sodium tripolyphosphate (60–80% Phase I, 3–5% $H_2O$) | 11 |
| potassium orthophosphate (prepared in situ from $H_3PO_4$ and KOH) | 7 |
| potassium carbonate | 2 |
| dye, perfume, preservative | 0.5 |
| water | balance |

I claim:

1. In a process for the preparation of an aqueous built liquid detergent composition containing 2 to 20% by weight of an active detergent, at least about 12% by weight of sodium tripolyphosphate, at least 2% by weight of an alkalimetal orthophosphate in which the alkali metal orthophosphate is produced in situ by neutralizing orthophosphoric acid by a suitable base, the sum of the two phosphate builders being about 14% to about 35% by weight, and a hydrotrope or stabilizing system, the improvement which comprises the step of adding from 0.5% to 5% by weight of a mono-, di- or trialkanolamine, wherein the alkanol constituent is ethanol, propanol or isopropanol.

2. The process of claim 1 wherein the alkanolamine is triethanolamine.

* * * * *